US006368165B2

(12) United States Patent
Kubo

(10) Patent No.: US 6,368,165 B2
(45) Date of Patent: Apr. 9, 2002

(54) CONNECTOR

(75) Inventor: Akinobu Kubo, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/726,317

(22) Filed: Dec. 1, 2000

(30) Foreign Application Priority Data

Dec. 2, 1999 (JP) ..... 11-343871

(51) Int. Cl.[7] ..... H01R 13/436
(52) U.S. Cl. ..... 439/752; 439/746
(58) Field of Search ..... 439/752, 595, 439/746–749

(56) References Cited

U.S. PATENT DOCUMENTS 5,224,879 A * 7/1993 Mullins et al. ..... 439/746
5,632,536 A * 5/1997 Kitamura ..... 439/752
6,050,860 A * 4/2000 Tsuchiya ..... 439/746
6,080,023 A * 6/2000 Meulemeester et al. .... 439/752
6,116,954 A * 9/2000 Ries ..... 439/752

FOREIGN PATENT DOCUMENTS

JP 63-257187 10/1998

* cited by examiner

*Primary Examiner*—Gary Paumen
(74) *Attorney, Agent, or Firm*—Banner & Witcoff, Ltd.

(57) ABSTRACT

The invention provides a connector wherein a terminal fitting provided with a metal lance is retained by a retainer. A cavity 21 is formed within a housing 20 and is capable of housing a terminal fitting 10 provided with a metal lance 15. A retainer attachment hole 22 opens into the cavity 21 and allows the attachment of a retainer 30 which engages with the terminal fitting 10. This retainer attachment hole 22 opens into a lower face of the housing 20. A stopping wall 24 which retains the metal lance 15 is formed at an anterior side of the cavity 21 and, to its anterior is a jig insertion hole 26 from which a jig for bending the metal lance 15 can be inserted. Another jig insertion hole 40 is formed in a posterior end of the retainer 30. Another jig 51 is inserted therein, extends along a posterior end face 23A of an opening 23 of the retainer attachment hole 22, and thereby bends the metal lance 15 which is caught against the posterior end face 23A of the opening 23.

7 Claims, 4 Drawing Sheets

CONNECTOR

TECHNICAL FIELD

The present invention relates to an electrical connector which houses terminal fittings provided with metal lances.

BACKGROUND TO THE INVENTION

Conventionally, connectors use metal lances to retain terminal fittings. An example thereof is shown in FIG. 11 of this specification. This type of connector has a configuration whereby a metal lance 2 is cut out from a side wall of a terminal fitting 1, and a step 4 is formed on a side face of a cavity 3 of a housing 5. The metal lance 2 bends while the terminal fitting 1 is being inserted into the cavity 3. After the terminal fitting 1 has been pushed in to a specified position, the metal lance 2 returns to its original position and engages with the step 4, thereby preventing the removal of the terminal fitting 1.

A connector with this type of configuration is described in JP-63-257187.

This configuration using metal lances, whereby the lances serve to retain the terminal fitting against the side wall of the cavity, generally has a much greater retaining force than a configuration using plastic lances. Consequently, double retaining, using a retainer or the like, is not performed. However, terminal fittings have been miniaturised in recent years, and consequently the metal lances have also become smaller. As a result, there is the danger that the retaining force of the metal lances alone may be insufficient, and it has been proposed that connectors which use metal lances should also be doubly retained by retainers.

In response to this, it was proposed that a retainer attachment hole 6 (shown by the chain line in FIG. 11) be formed in a side face of the housing 5, this retainer attachment hole 6 opening into the cavity 3. A retainer provided with a fitting member is inserted from the side into the retainer attachment hole 6. After the terminal fitting 1 has been inserted into the cavity 3 and is retained therein by the metal lance 2, the retainer is pushed further inwards, and the fitting member engages with a cog member 7 of the terminal fitting 1, thereby doubly retaining the terminal fitting 1.

In the configuration described above, the means of doubly retaining the terminal fitting 1 is effective. However, problems arise when the terminal fitting 1 is to be removed from the cavity 3 for maintenance or the like. That is, when the terminal fitting 1 is to be removed, the retainer is pushed back, a jig is inserted from the anterior of the stopping stepped member 4, the metal lance 2 is bent, thereby releasing its engagement, and the terminal fitting 1 is pulled out. However, as has been explained, the retainer attachment hole 6 opens into the side wall of the cavity 3 through which the metal lance 2 passes. Consequently, there is the problem that the metal lance 2 returns to its original position at the time it passes the retainer attachment hole 6, and it catches with a hole edge thereof. As a result, the terminal fitting 1 cannot be easily removed.

The present invention has taken the above problem into consideration, and aims to present a connector wherein a terminal fitting is retained by a metal lance, and is doubly retained by a retainer.

According to the invention there is provided an electrical connector comprising a housing, a cavity in the housing and an electrical terminal insertable from a posterior side into said cavity, the terminal having a resilient lance part-sheared therefrom and engageable with a step of said cavity in order to retain the terminal from movement to the posterior side, and the housing having a jig insertion hole adapted to receive a jig for bending said lance to release engagement thereof with said step, and said housing further including an aperture opening into said cavity at the posterior side of said step, and a retainer insertable into said aperture and engageable with an abutment of said terminal to doubly retain said terminal from movement to said posterior side, the retainer and housing being engageable in a temporary position in which said terminal may be inserted into said cavity, and a final position in which said retainer and abutment are engaged characterized in that said retainer includes a jig insertion opening adapted to receive a jig for bending said lance to release engagement thereof with said aperture to permit removal of said terminal from said cavity. Such an arrangement conveniently permits release of the lance with a second jig, and permits removal of the terminal.

The jig insertion opening preferably extends at right angles to the direction of said cavity, and comprises an open channel in the posterior side of said retainer.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 10. This embodiment shows a female connector which houses a terminal fitting provided with a metal lance.

Figure 2:
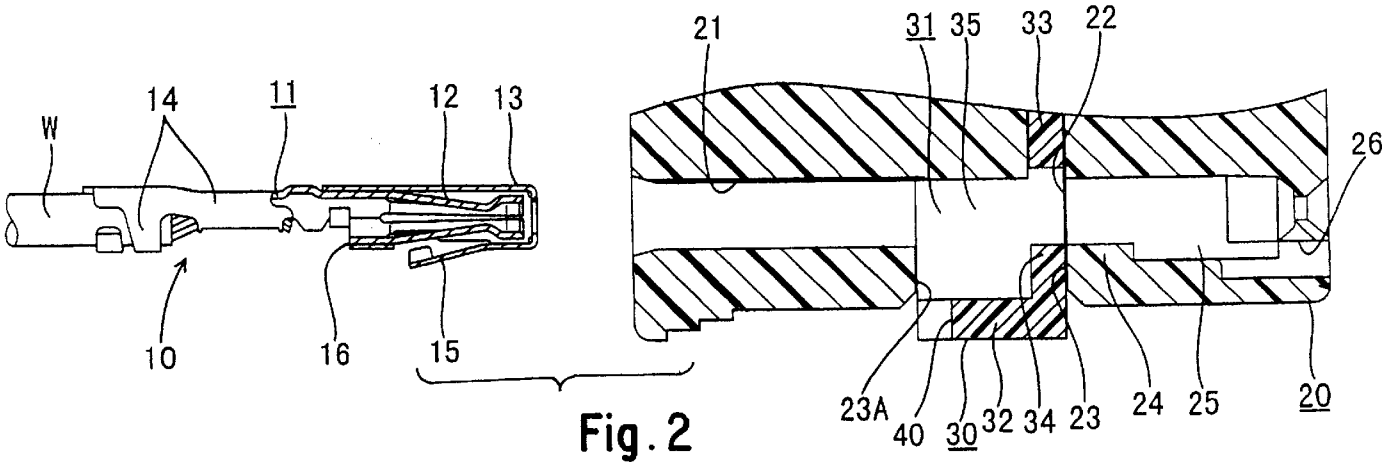
FIG. 2 is a cross-sectional view along the line X—X of FIG. 1 showing the housing and a terminal fitting.

The terminal fitting 10 will be described first. As shown in FIG. 2, the terminal fitting 10 is formed from a terminal main body 11 provided with a connecting member 12 which connects with a corresponding male terminal fitting, and a cylindrical cover 13 which is attached so as to surround the connecting member 12. A barrel member 14, which is attached by crimping to an electric wire W, is formed to the posterior of the connecting member 12 of the terminal main body 11. A cantilevered metal lance 15 is cut out from a lower face (relative to FIG. 2) of the cover 13. This metal lance 15 has its base end at its anterior side, and is capable of bending inwards. A posterior end of the connecting member 12 of the terminal main body 11 and a posterior end of the cover 13 join at a lower face side of the terminal fitting 10 to form a cog member 16 capable of fitting with a retainer 30.

Figure 1:
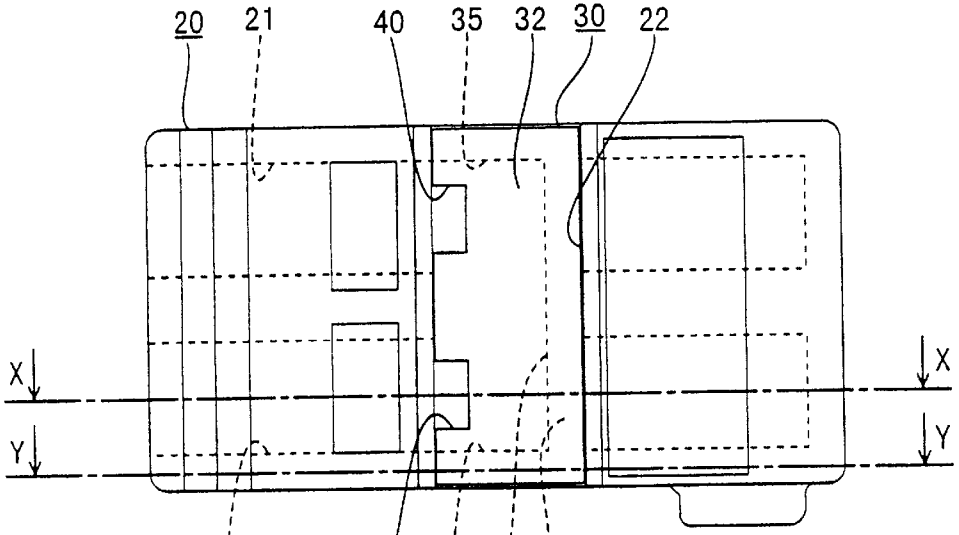
FIG. 1 is a base face view of a housing of an embodiment of the present invention.

Next, a connector housing 20 (hereafter referred to simply as housing 20) will be described. As shown in FIGS. 1 and 2, the housing 20 has two cavities 21 aligned therein in a width-wise direction. The terminal fittings 10 are inserted from the posterior into these cavities 21. A plurality of upper and lower steps are provided within the cavities 21. Only the lowermost step will be described below. A retainer attachment hole 22, to which the retainer 30 can be attached, is formed in the housing 20 at an approximately central location relative to the length-wise direction of the cavity 21. This retainer attachment hole 22 intersects with the cavity 21 in an up-down direction relative to FIG. 2. The retainer attachment hole 22 forms an opening 23 of a specified length in a lower face of the housing 20.

Figure 4:
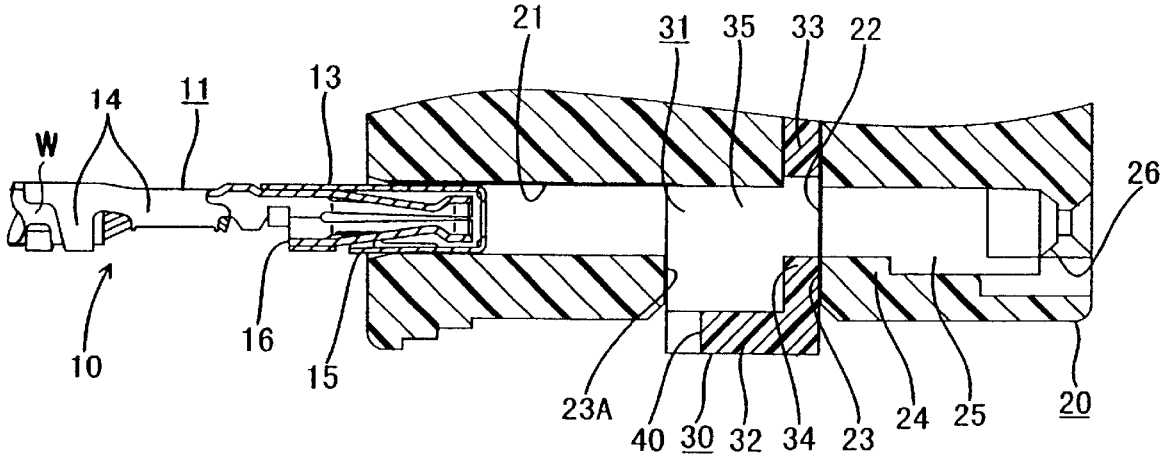
FIG. 4 is a cross-sectional view along the line X—X of FIG. 1 showing the terminal fitting being inserted into a cavity.

As shown in FIG. 4, when the terminal fitting 10 is inserted into the cavity 21, the metal lance 15 thereof makes contact with a base face of the cavity 21 and bends. When the metal lances 15 passes the opening 23 of the retainer attachment hole 22 it returns to its original position, and then it is again bent by a stopping wall 24 provided to the anterior of the retainer attachment hole 22. When the metal lance 15 reaches a bending space 25 at the anterior of the stopping wall 24, it again returns to its original position, and is retained by the stopping wall 24 (see FIG. 5). The depth to which the terminal fitting 10 has been inserted when the metal lance 15 is retained by the stopping wall 24 is the correct inserting position of the terminal fitting 10. An opening is formed in an anterior end portion of the housing 20 at a location to the anterior of the bending space 25, this forming a first jig insertion hole 26 into which a jig 50 is inserted from the anterior to bend the metal lance 15.

Figure 3:
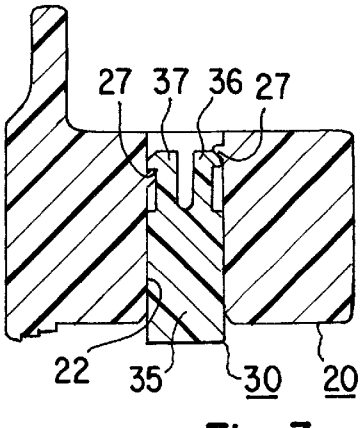
FIG. 3 is a cross-sectional view along the line Y—Y of FIG. 1 showing the housing.

The retainer attachment hole 22 (both side edges of the opening 23 thereof are shown in FIG. 1) passes through to an upper face of the housing 20 (as shown in FIG. 3). Protrusions 27 are formed in side grooves of the retainer attachment hole 22, on mutually opposing anterior and posterior walls. The anterior protrusion 27 is formed at a higher location, relative to FIG. 3, and the posterior protrusion 27 is formed at a lower location. Side plates 35 of the retainer 30 are inserted into these side grooves, and stopping claws 36 and 37 of the side plates 35 catch with these two protrusions, thereby maintaining the position of the retainer 30 in both up and down directions. The side grooves are formed by cutting away side walls of exterior sides of the cavity 21.

As shown in FIGS. 1 and 2, the retainer 30 is approximately C-shaped and is provided with a main body 31 which, as shown in FIG. 2, is inserted upwards into the opening 23 of the retainer attachment hole 22. A base plate 32 which fits with the opening 23 of the retainer attachment hole 22 is formed at a lower end of the main body 31.

The main body 31 is provided with anterior plates 33 which extend along the width-wise direction of the housing 20 and are provided directly to the posterior of the stopping wall 24 within the retainer attachment hole 22. Holes provided in these anterior plates 33 join with the cavity 21, the terminal fitting 10 being capable of passing through these holes. A fitting member 34 which fits with the cog member 16 of the terminal fitting 10 is provided below the holes.

As shown in FIG. 3, the side plates 35 provided on both side edges of the pair of anterior plates 33 of the main body 31 are inserted into the grooves at the sides of the retainer attachment hole 22. The main stopping claw 36 and the temporary stopping claw 37 are provided to the anterior and the posterior respectively on upper edges of the side plates 35. These stopping claws 36 and 37 fit with the protrusions 27 of the housing 20.

As shown in FIG. 3, when the posteriorly located stopping claw 37 fits with the protrusion 27, the base plate 32 of the retainer 30 protrudes from the lower face of the housing 20. At this juncture, as shown in FIG. 2, an upper face of the fitting member 34 is positioned so as to form an approximately unified face with an upper face of the stopping wall 24 which is located to its anterior. This allows the terminal fitting 10 to be inserted into the cavity 21, and the metal lance 15 engages with these upper faces as this insertion progresses, thereby causing the metal lane 15 to bend. At this juncture, the retainer 30 is in a temporary retaining position.

Figure 6:
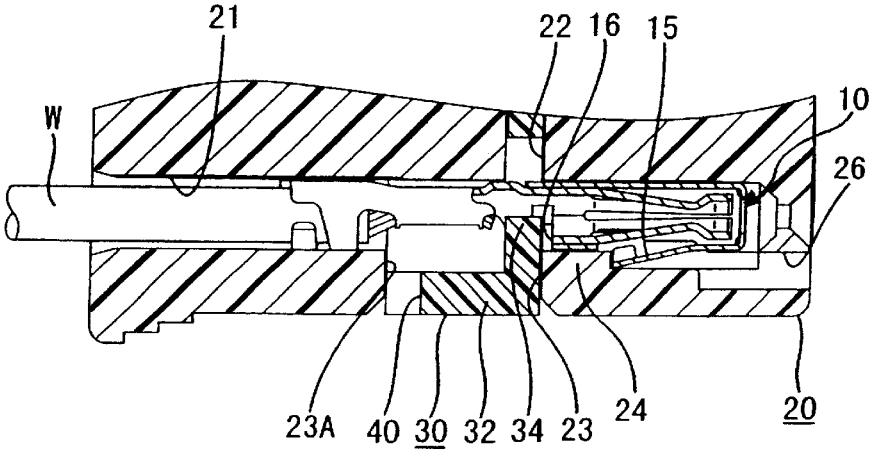
FIG. 6 is a cross-sectional view along the line X—X of FIG. 1 showing the terminal fitting doubly retained by a retainer.
Figure 7:
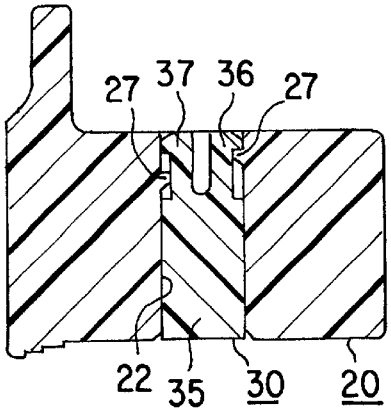
FIG. 7 is a cross-sectional view along the line Y—Y of FIG. 1 showing the retainer in a state whereby it has been moved to a main retaining position.

As shown in FIG. 7, after the anteriorly located main stopping claw 36 has risen over the protrusion 27, it fits therewith, and the lower face of the base plate 32 of the retainer 30 forms an approximately unified face with the lower face of the housing 20. At this juncture, as shown in FIG. 6, the fitting member 34 enters upwards into the cavity 21 and fits immediately to the posterior of the cog member 16 of the terminal fitting 10. Now the retainer 30 is in the main retaining position.

Figure 9:
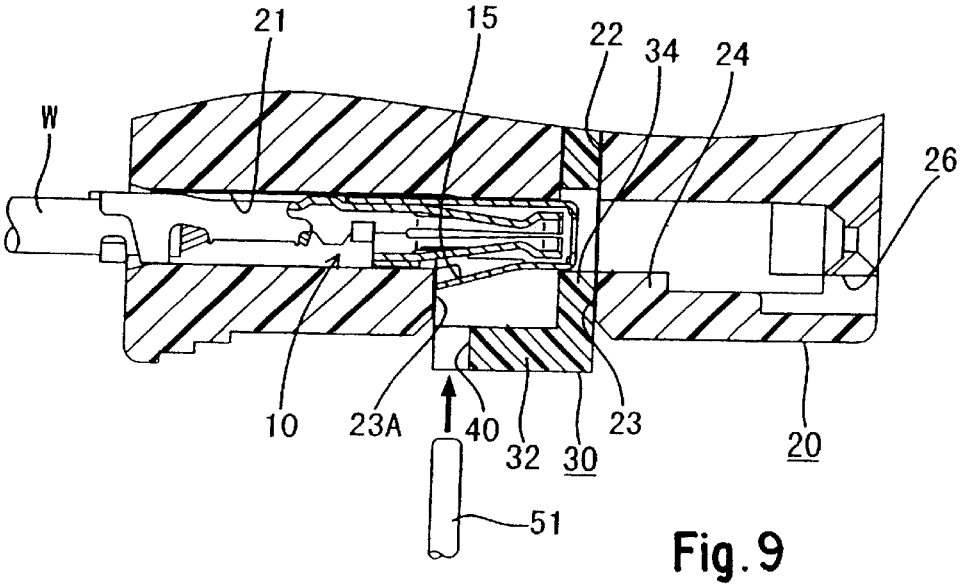
FIG. 9 is a cross-sectional view along the line X—X of FIG. 1 showing a state prior to a jig being inserted from below into a second jig insertion hole.

A second jig insertion hole 40 passes through a posterior end of the base plate 32 of the retainer 30, and a jig 51 (this differs from the jig 50) is inserted therein from below. The second jig insertion hole 40 is formed at an approximately central location relative to the width-wise direction of the cavity 21. As shown in FIG. 9, the metal lance 15 of the terminal fitting 10 can be pressed by the jig 51 which has been inserted into the second jig insertion hole 40 when the metal lance 15 is located in the vicinity of this second jig insertion hole 40. The second jig insertion hole 40 passes directly through the base plate 32 from its upper to its lower side. Consequently the direction in which the jig 51 is inserted is at a right angle to the direction of insertion of the terminal fitting 10.

Figure 10:
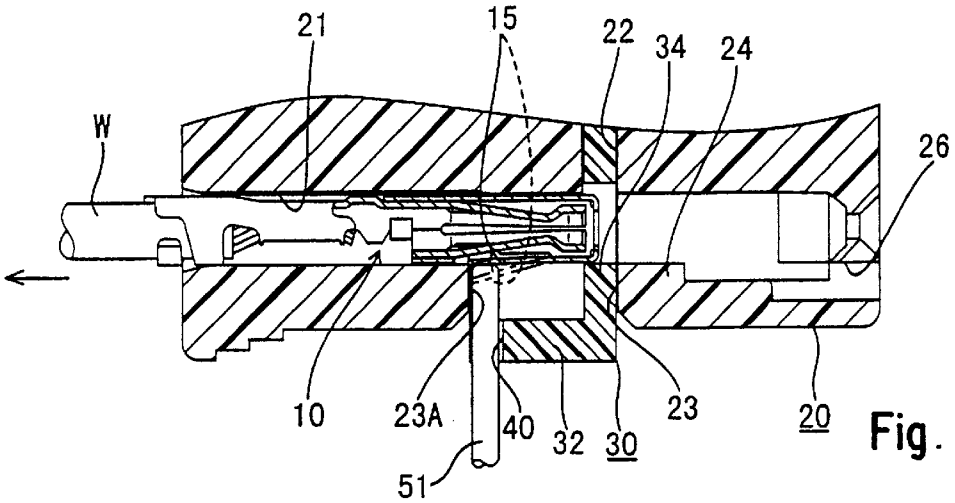
FIG. 10 is a cross-sectional view along the line X—X of FIG. 1 showing the jig in an inserted state within the second jig insertion hole.
Figure 11:
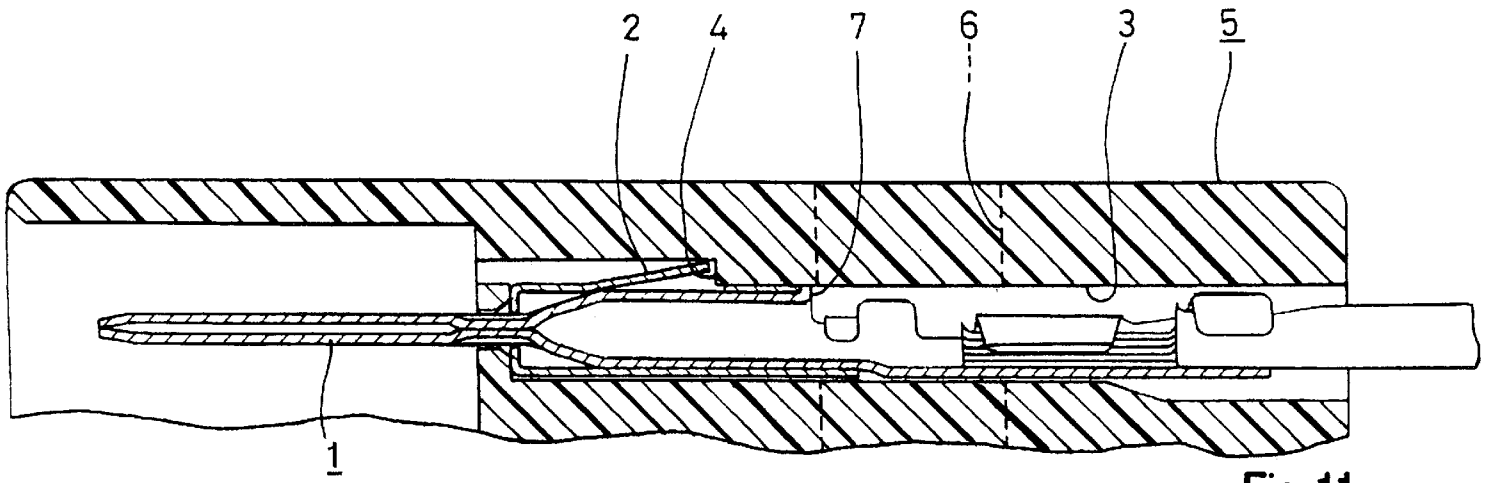
Fig. 11 PRIOR ART
FIG. 11 is a cross-sectional view of a prior art example.

The second jig insertion hole 40 is provided at the posterior end of the retainer 30. That is, it opens immediately to the anterior of the posterior end face 23A of the opening 23 of the retainer attachment hole 22. As shown in FIG. 10, the jig 51 can be inserted along the posterior end face 23A of the opening 23. As a result, the jig 51 makes direct contact with and releases the posterior end of the metal lance 15 that is caught against the posterior end face 23A of the opening 23.

Figure 5:
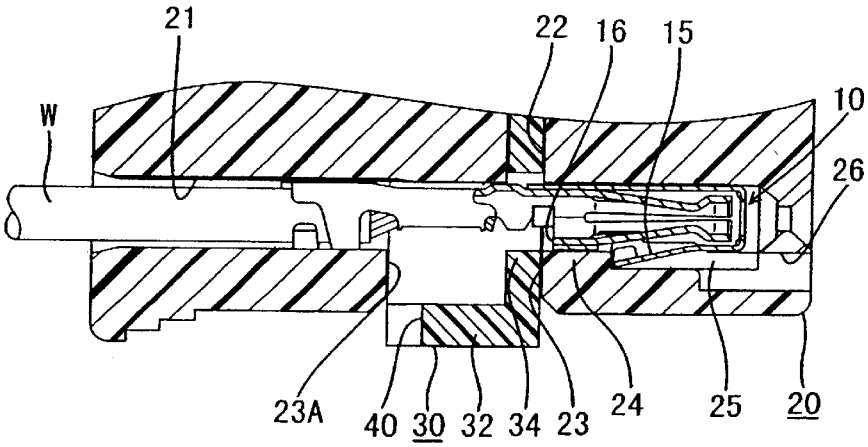
FIG. 5 is a cross-sectional view along the line X—X of FIG. 1 showing the terminal fitting in a state where it has been pushed in to a correct inserting position.

The present embodiment is configured as described above. Next, the operation thereof will be described. As shown in FIG. 1, after the retainer 30 has been attached to the housing 20 in the temporary retaining position, the terminal fitting 10 is inserted into the cavity 21. As shown in FIG. 5, pushing the terminal fitting 10 in to the correct inserting position causes the metal lance 15 to be retained by the stopping wall 24. The terminal fitting 10 is then in a first retained state.

Next, as shown in FIG. 6, the retainer 30, which is in the temporary retaining position, is pushed upwards into the main retaining position. The fitting member 34, which moves upwards as the retainer 30 moves, fits directly to the posterior of the cog member 16 of the terminal fitting 10. By this means, the terminal fitting 10 is in a doubly retained state. That is, it is doubly retained within the housing 20.

Figure 8:
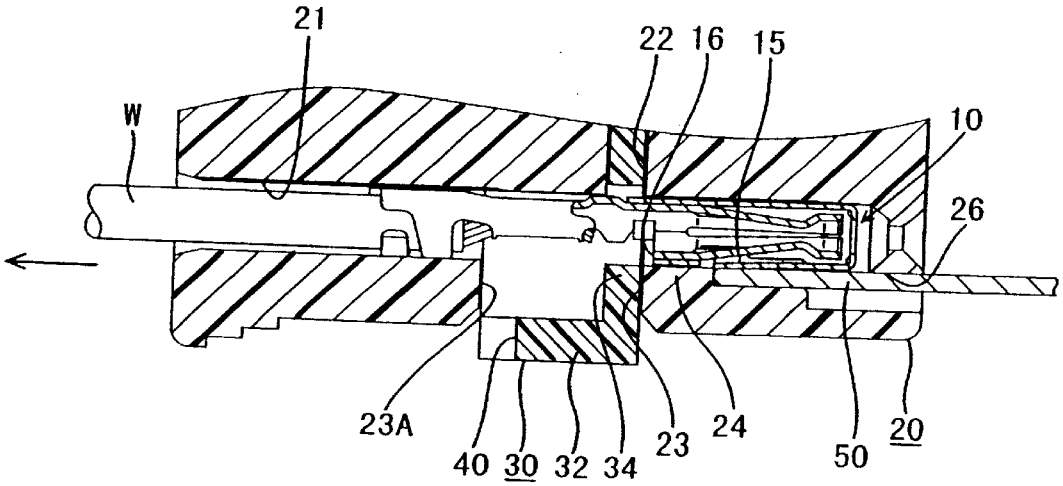
FIG. 8 is a cross-sectional view along the line X—X of FIG. 1 showing a jig being inserted from the anterior via a first jig insertion hole.

The terminal fitting 10 may need to be removed from the housing 20 for maintenance or the like. In such a situation, the retainer 30 is moved to the temporary retaining position and the doubly retained state provided by the fitting member 34 is released. Then, as shown in FIG. 8, the jig 50 is inserted from the anterior into the first jig insertion hole 26 at the anterior end face of the housing 20 and bends the metal lance 15 which is retained by the stopping wall 24. Its retained state is thereby released, and the terminal fitting 10 is removed by pulling the electric wire W.

The terminal fitting 10 is removed while the metal lance 15 is in a bent state. When the posterior end of the metal lance 15 has just passed the fitting member 34 of the retainer 30 and enters the opening 23 of the retainer attachment hole 22, the metal lance 15 returns to its original position. As shown in FIG. 9, when the terminal fitting 10 is moved further, the metal lance 15 catches with the posterior end face 23A of the opening 23 of the retainer attachment hole 22. At this juncture, the jig 51 is inserted upwards into the second jig insertion hole 40 formed in the retainer 30, this jig 51 extending along the posterior end face 23A of the opening 23 of the retainer attachment hole 22. Consequently, as shown in FIG. 10, the metal lance 15, which is catching with the posterior end face 23A of the opening 23, is bent. The catching state of the metal lance 15 is released, and the terminal fitting 10 can therefore be removed from the cavity 21.

In this manner, since the second jig insertion hole 40 is provided in the retainer 30, the jig 51 can be used to release the metal lance 15 from its catching state with the posterior end face 23A of the opening 23 of the retainer attachment hole 22 as the terminal fitting 10 is removed. Consequently, the terminal fitting 10 is removed smoothly and operability is improved.

Furthermore, the second jig insertion hole 40 is provided directly to the anterior of the posterior end face 23A of the opening 23 of the retainer attachment hole 22. As a result, the jig 51 can be inserted along this posterior end face 23A of the opening 23 which has the metal lance 15 caught against it. The posterior end of this metal lance 15, which is caught against the posterior end face 23A of the opening 23, is pushed, thereby bending the metal lance 15 so that its posterior end is pushed into the terminal fitting 10. By this means, the metal lance 15 is reliably prevented from catching.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the case where the second jig insertion hole is provided in the posterior end of the retainer has been described. However, the second jig insertion hole may equally well be provided at a location to the anterior of the posterior end of the retainer. For example, if the second jig insertion hole is provided within the length of the metal lance from the posterior end of the retainer, a jig inserted therefrom can bend the metal lance which is caught against the hole edge of the retainer attachment hole. Furthermore, the second jig insertion hole may be inclined, opening towards the anterior at its outer side, and the jig being inserted therein in an inclined manner from the anterior.

(2) The present invention is not limited to a female connector. It is also suitable for a male connector.

What is claimed is:

1. An electrical connector comprising a housing, a cavity defined in the housing and an electrical terminal insertable from a posterior side into said cavity, the terminal having a resilient lance part-sheared therefrom and engageable with a step of said cavity in order to retain the terminal from movement to the posterior side, and the housing having a jig insertion hole defined therein and adapted to receive a jig for bending said lance to release engagement thereof with said step, and said housing further including an aperture defined therein and opening into said cavity at the posterior side of said step, and a retainer insertable into said aperture and engageable with an abutment of said terminal to doubly retain said terminal from movement to said posterior side, the retainer and housing being engageable in a temporary position in which said terminal may be inserted into said cavity, and a final position in which said retainer and abutment are engaged wherein said retainer includes a jig insertion opening adapted to receive a jig for bending said lance to release engagement thereof with said aperture to permit removal of said terminal from said cavity.

2. A connector according to claim 1 wherein said jig insertion opening extends orthogonally to said cavity.

3. A connector according to claim 1 wherein said jig insertion opening opens into said cavity at the posterior side of said aperture.

4. A connector according to claim 2 wherein said jig insertion opening opens into said cavity at the posterior side of said aperture.

5. A connector according to claim 3 wherein said jig insertion opening extends along the posterior side of said aperture, and comprises an open channel of said retainer.

6. A connector according to claim 4 wherein said jig insertion opening extends along the posterior side of said aperture, and comprises an open channel of said retainer.

7. A connector according to claim 1 wherein the direction of said jig insertion hole is parallel to the direction of said cavity.

* * * * *